US007931519B2

(12) United States Patent
Fox

(10) Patent No.: US 7,931,519 B2
(45) Date of Patent: Apr. 26, 2011

(54) FINGERBOARD SKATEBOARD

(76) Inventor: Jeremy Fox, Huntington Beach, CA (US)

( * ) Notice: Subject to any disclaimer, the term of this patent is extended or adjusted under 35 U.S.C. 154(b) by 393 days.

(21) Appl. No.: 12/030,753

(22) Filed: Feb. 13, 2008

(65) Prior Publication Data

US 2008/0197595 A1 Aug. 21, 2008

Related U.S. Application Data

(60) Provisional application No. 60/889,846, filed on Feb. 14, 2007.

(51) Int. Cl.
*A63H 17/00* (2006.01)

(52) U.S. Cl. ..... 446/431; 446/465; 280/87.042

(58) Field of Classification Search ..... 446/440, 446/327, 460, 465, 279, 275; 280/87.042
See application file for complete search history.

(56) References Cited

U.S. PATENT DOCUMENTS

| | | | | |
|---|---|---|---|---|
| 4,076,267 | A * | 2/1978 | Lipscomb | 280/87.042 |
| 4,082,306 | A * | 4/1978 | Sheldon | 280/87.042 |
| 4,168,076 | A | 9/1979 | Johnson | |
| 4,195,857 | A * | 4/1980 | Hechinger | 280/87.042 |
| 5,129,851 | A * | 7/1992 | Villanueva | 446/26 |
| 5,417,444 | A * | 5/1995 | Chen | 280/87.042 |
| 5,505,474 | A * | 4/1996 | Yeh | 280/87.042 |
| 5,540,455 | A * | 7/1996 | Chambers | 280/87.042 |
| 6,131,931 | A * | 10/2000 | Globerson et al. | 280/87.042 |
| 6,146,237 | A * | 11/2000 | Rehkemper et al. | 446/440 |
| 6,371,828 | B1 * | 4/2002 | Ngan | 446/450 |
| 6,431,943 | B1 * | 8/2002 | Rehkemper et al. | 446/440 |
| 6,533,638 | B1 * | 3/2003 | Nelson et al. | 446/279 |
| 6,540,577 | B1 * | 4/2003 | Nelson et al. | 446/465 |
| 6,939,196 | B2 * | 9/2005 | Bellon | 446/440 |
| 6,979,006 | B2 * | 12/2005 | Pierron | 280/87.042 |
| 7,083,178 | B2 * | 8/2006 | Potter | 280/87.042 |
| 7,195,259 | B2 * | 3/2007 | Gang | 280/87.042 |
| 7,325,819 | B2 * | 2/2008 | Kwak | 280/87.042 |
| 7,338,056 | B2 * | 3/2008 | Chen et al. | 280/87.042 |
| 7,367,572 | B2 * | 5/2008 | Jiang | 280/87.042 |
| 7,484,742 | B2 * | 2/2009 | Choi | 280/87.042 |
| 7,600,768 | B2 * | 10/2009 | Chen et al. | 280/87.042 |
| 7,628,413 | B2 * | 12/2009 | Gallipoli | 280/87.05 |
| 7,635,137 | B2 * | 12/2009 | Gregory et al. | 280/87.05 |
| 2002/0149166 | A1 * | 10/2002 | Potter | 280/87.042 |
| 2002/0182975 | A1 * | 12/2002 | Schaffer | 446/327 |
| 2004/0155420 | A1 * | 8/2004 | Pierron | 280/87.042 |
| 2007/0029750 | A1 * | 2/2007 | Gregory et al. | 280/87.042 |
| 2007/0273118 | A1 * | 11/2007 | Conrad | 280/87.042 |
| 2009/0166993 | A1 * | 7/2009 | Jackman et al. | 280/87.042 |
| 2009/0200764 | A1 * | 8/2009 | Jang et al. | 280/87.042 |

* cited by examiner

*Primary Examiner* — Gene Kim
*Assistant Examiner* — Urszula M Cegielnik
(74) *Attorney, Agent, or Firm* — Advantage IP Law Firm

(57) ABSTRACT

A device and a mechanism is provided for incorporation of traditional skateboard maneuvers on a miniature level. The device may be a toy fingerboard skateboard that may be utilized to perform common skateboard tricks. The device may have a spring click mechanism that is incorporated into the toy skateboard design whereby the spring may be placed at the tail kick section of the skateboard. The device may allow for pressure to be placed on the spring click portion of the board thereby increasing the traction to the front of the board which in turn allows the skateboard to lift from the surface in which it is placed. The increased traction and pressure on the fingerboard allows for the performance of different skateboarding tricks that are typically not successful with the fingerboard skateboard because of traction and size limitations.

17 Claims, 2 Drawing Sheets

FINGERBOARD SKATEBOARD

PRIORITY DATA

This patent claims priority to the earlier filed U.S. Provisional Application No. 60/889,846 and filed on Feb. 14, 2007.

FIELD OF THE INVENTION

The invention relates generally to the field of amusement and recreational devices. More specifically, the present invention relates to a toy skateboard.

BACKGROUND OF THE INVENTION

Skateboarding as a sport was first started in the United States around the 1950s. Typically, it was a result of California surfers' desire to surf on the streets. Skateboards originated as wooden boxes or boards with roller skate wheels slapped to the bottom. Because of this rudimentary design, many skateboarders were injured during this period. Eventually, the boxes turned into other types of wood including pressed wood and the like.

However, after a decade, the popularity of skateboarding began to subside. Many toy experts assumed that the sport/toy was a fad and that the fad had run its course, whereby most young people weren't into the sport any longer. However, there were those that continued the tradition of skateboarding, although much fewer in numbers.

Later in the evolution of skateboarding, a development was made in skateboard technology which saw the invention of the urethane skateboard wheel, which is still used today.

The skateboards also evolved from simple wooden boxes to shaped boards with accompanying tails. Boards that are in the market are now constructed to have no clear front or back side, thereby allowing a skateboarder to ride either way on the board more easily. The wheels of a skateboard began as metal roller skate wheels, to rubber wheels, and eventually to lighter and cheaper urethane wheels.

Boards have continued to evolve, as companies try to make them lighter and stronger, and continue to try to improve on their performance. As skateboards developed and improved in performance, the popularity of skateboarding began to grow again. One thing that has remained constant through the last 50 years is that skateboarding has always been about personal discovery and pushing oneself to the limit.

A skateboard trick sometimes referred to as a "ollie trick", is a maneuver performed on a skateboard while skateboarding. Learning and perfecting new tricks derived from these "ollies" is the major goal of many skateboarders. A primary objective for many skateboarders is learning and developing new tricks.

One of the most popular types of skateboard tricks is called the "ollie." An ollie is the term used to describe the most popular trick performed in modern skateboarding. This trick is a jumping move using the rider's legs and foot coordination to elevate the skateboard above the ground without the need for the rider to use their hands. Additionally, the ollie trick is to be performed without the need for any additional gear including straps or foot holding devices.

The ollie maneuver is very difficult to replicate with a hand while playing with a miniature toy skateboard, often called a fingerboard. The intricate motions afforded by a skateboard rider's leg and foot movements are practically impossible to replicate with a user's hand and/or finger movements. The inherent restrictions in hand and finger movements in performing the ollie with a fingerboard, lead to difficulty in maintaining traction with the finger as is done using the front foot on a full size skateboard.

A need therefore exists for an improved fingerboard skateboard that may enhance the user's ability to perform traditional skateboard tricks based upon the "ollie" thereon.

Additionally, a need therefore also exists for an entertaining yet easy to use fingerboard skateboard that allows for the user's ability to perform the same tricks that they would be able to produce on a traditional, full sized skateboard. Moreover, a fingerboard skateboard is needed that eliminates the difficulty of maneuverability and dexterity of a user in performing common skateboard techniques on a fingerboard skateboard.

SUMMARY OF THE INVENTION

The present invention relates to a device and mechanism for incorporation of traditional skateboard maneuvers on a miniature level. The device may be a toy fingerboard skateboard that may be utilized to perform common skateboard tricks. The device may have a spring click mechanism that is incorporated into the toy skateboard design whereby the spring may be placed to operate at the tail kick section of the skateboard. The device may allow for pressure to be placed on the spring click portion of the board thereby increasing the traction to the front of the board which in turn allows the skateboard to lift from the surface in which it is placed. The increased traction and pressure on the fingerboard allows for the performance of different skateboarding tricks that are typically not successful with the a feeling and visual of authenticity with the fingerboard skateboard because of traction and size limitations.

To this end, in an exemplary embodiment of the present invention, a device for entertainment of an individual is provided. The device comprising of a fingerboard skateboard; the skateboard having a principle, front portion, a rear portion and two side portions. Additionally, the fingerboard skateboard has a plurality of wheels attached to a bottom portion of the skateboard whereby the top portion of the skateboard is adapted for engagement by the fingers of an individual. The device may also have an attachment means between at least the front portion and the rear portion.

In an exemplary embodiment, the device has an attachment means whereby the attachment means is a spring mechanism positioned between the front portion and the rear portion.

In an exemplary embodiment, the device has an attachment means wherein the attachment means is a hinge.

In an exemplary embodiment, the device has an attachment means wherein the attachment means is integrally attached to the front portion of the fingerboard skateboard.

In an exemplary embodiment, the device has an attachment means which is integrally attached to the back portion of the fingerboard skateboard.

In an exemplary embodiment, the device has an attachment means that allows for flexion of the rear portion of the skateboard relative to the front portion of the skateboard.

In an exemplary embodiment, the device has a plurality of wheels that may be positioned on a bottom side of the board and further wherein the plurality of wheels may be attached to the bottom side of the front portion of the skateboard.

In an exemplary embodiment, the device has a plurality of wheels that may be positioned on a bottom side of the board and further wherein a first set of wheels may be positioned beneath the bottom side of the front portion of the skateboard, and a second set of wheels may be positioned beneath the bottom side of the rear portion of the skateboard.

In an exemplary embodiment, the device has an axle attached to the plurality of wheels such that the axle may allow for independent movement of the wheels relative to one another.

In an exemplary embodiment, the device has an axle attached to the plurality of wheels such that the axle may prevent movement of a pair of wheels relative to one another.

To this end, in an exemplary embodiment of the present invention, a method of using an entertainment device is provided. The method comprising the steps of: providing a fingerboard skateboard, the skateboard having a front portion, a rear portion and two side portions; attaching a plurality of wheels to a bottom portion of the skateboard; and providing an attachment means between at least the front portion and the rear portion.

In an exemplary embodiment, the method further comprises the step of: positioning at least a finger on a top portion of the skateboard.

In an exemplary embodiment, the method further comprises the step of: providing a spring mechanism in the attachment means to allow for flexion of the rear portion relative to the front portion.

In an exemplary embodiment, the method further comprises the step of: applying pressure to the rear portion of the skateboard thereby causing the rear portion to angle towards a flat surface in which the skateboard is in contact therewith.

In an exemplary embodiment, the method further comprises the step of: applying pressure to the rear portion of the skateboard which in turn allows for elevation of the front portion of the skateboard.

In an exemplary embodiment, the method further comprises the step of: utilizing a user's fingers to perform various skateboard tricks and stunts with the fingerboard skateboard.

In an exemplary embodiment, the device further has a spring means wherein the spring means is a spring click mechanism.

In an exemplary embodiment, the device further has a spring means wherein the spring means is a hinge.

In an exemplary embodiment, the device further has a spring means that is integrally attached to the front portion of the fingerboard skateboard.

In an exemplary embodiment, the device further has a spring means that is integrally attached to the back portion of the fingerboard skateboard.

In an exemplary embodiment, the device further has an attachment mechanism between the spring means and the side portion of the fingerboard skateboard.

To this end, in an exemplary embodiment of the present invention, an entertainment apparatus relating to the sport of skateboarding is provided.

In another exemplary embodiment, an entertainment apparatus relating to the sport of skateboarding is provided whereby the apparatus is a miniature skateboard.

Yet another exemplary embodiment of the present invention is to provide a fingerboard skateboard whereby the fingerboard skateboard may be utilized for entertainment purposes.

Still another exemplary embodiment of the present invention is to provide a fingerboard skateboard whereby the fingerboard skateboard may be constructed of wood.

In another exemplary embodiment of the present invention is to provide a fingerboard skateboard whereby the fingerboard skateboard may be constructed of plastic.

Still another exemplary embodiment of the present invention is to provide a fingerboard skateboard wherein the device may be constructed of metal.

An exemplary embodiment of the present invention is to provide a fingerboard skateboard whereby the fingerboard skateboard may be utilized to perform common skateboarding tricks.

Yet another exemplary embodiment is a fingerboard skateboard that may be constructed of any resilient material.

Another exemplary embodiment of the present invention is to provide a fingerboard skateboard whereby the skateboard may have a hinge thereon.

Still another exemplary embodiment of the present invention is to provide a fingerboard skateboard whereby the skateboard may have a spring located on the tail section of the board.

Yet another exemplary embodiment of the present invention is to provide a fingerboard skateboard that may be constructed of polyurethane.

An exemplary embodiment of the present invention is to provide a fingerboard skateboard whereby the skateboard may have a spring located on the front portion of the board.

Yet another exemplary embodiment of the present invention is to provide a fingerboard skateboard whereby the fingerboard skateboard may have a spring click mechanism incorporated into any portion of the skateboard.

Still another exemplary embodiment of the present invention is to provide a fingerboard skateboard whereby the board may have a spring click mechanism that is incorporated into the toy skateboard, and is activated and released by finger pressure on the tail kick section of the fingerboard skateboard.

Another exemplary embodiment of the present invention is to provide a fingerboard skateboard whereby the common skateboard trick referred to as an ollie may be easily performed on the miniature fingerboard skateboard by utilizing the spring in the tail section of the fingerboard thereby giving greater traction to the board during use.

An exemplary embodiment of the present invention is to provide a fingerboard skateboard whereby the fingerboard skateboard may allow for increased pressure to be applied to the rear section of the fingerboard thereby allowing the user to more closely duplicate the traditional tricks that may be performed or executed by a standard traditional, full size skateboard.

Still another exemplary embodiment of the present invention is provide a fingerboard skateboard whereby a hinge, spring click or similar mechanism may be incorporated into at least a section of the board to allow for greater pressure to at least one portion of the board to increase traction and maneuverability of the board with the fingers of a user.

Yet another exemplary embodiment of the present invention is to provide a fingerboard skateboard whereby a hinge, spring click or similar mechanism may be incorporated into at least a section of the board to increase the tension afforded to a finger, by the pressing and release of the finger on the spring clip, hinge or similar mechanism loaded portion.

Yet another exemplary embodiment of the present invention is to provide a fingerboard skateboard whereby the toy may allow for a more substantial and authentic feel to performing a traditional skateboard trick on a miniature scale.

Another exemplary embodiment of the present invention is to provide a fingerboard skateboard whereby the toy may allow for a similar result to the performance of a skateboard trick as may result from a real full size board.

Still another exemplary embodiment of the present invention is to provide a fingerboard skateboard whereby a hinge, and/or spring may be provided allowing for flexion of the board at a particular portion of the board thereby allowing for greater pressure at a set location on the fingerboard skateboard.

Yet another exemplary embodiment of the present invention is to provide a fingerboard skateboard whereby a spring, hinge or other flexion mechanism may be provided whereby the spring, hinge or other flexion mechanism may allow for flexing and increased pressure to be placed on either the front portion or the rear portion of the fingerboard skateboard.

In yet another exemplary embodiment of the present invention is to provide a fingerboard skateboard whereby a spring, hinge or other flexion mechanism is provided whereby the spring, hinge or other flexion mechanism may be incorporated into the structure of the fingerboard skateboard and may be utilized by a single finger of a user to create more tension, pressure and friction which would closely simulate the tension, pressure and friction created by a real user utilizing a real skateboard.

Various objects, features, aspects and advantages of the present invention will become more apparent from the following detailed description of preferred embodiments of the invention, along with the accompanying drawings in which like numerals represent like components.

Additional features and advantages of the present invention are described herein, and will be apparent from the detailed description of the presently preferred embodiments and from the drawings.

DETAILED DESCRIPTION OF AN EXEMPLARY EMBODIMENT

Figure 1:
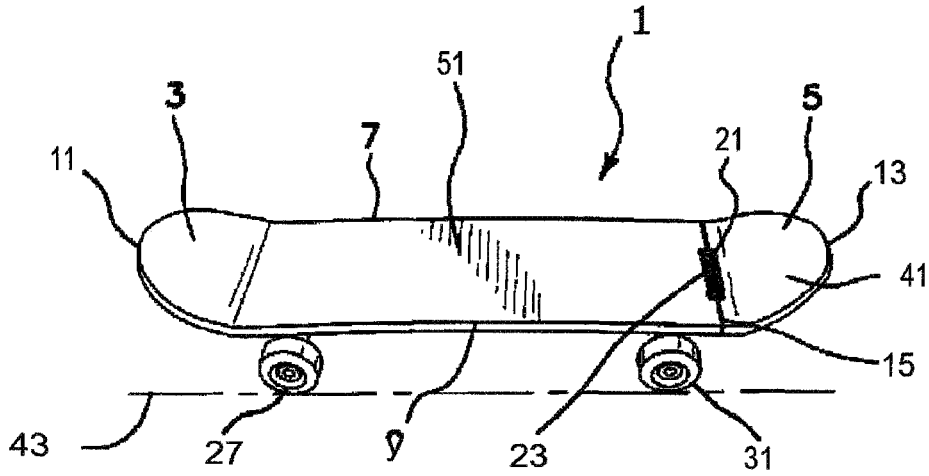
FIG. 1 is a front perspective view of the device in an exemplary embodiment of the present invention.

Referring now to the drawings where like numbers are utilized to described the preferred embodiment of the figures, FIG. 1 illustrates the fingerboard skateboard in one exemplary embodiment. The Fingerboard skateboard may have at least a front portion 3 and a rear portion 5. The front portion 3 and the rear portion 5 may be connected by at least a first side portion 7 and a second side portion 9. The first side portion 7 and the second side portion 9 may be equally equidistant from the rear portion 5 and the front portion 3. Additionally, the first side portion 7 and the second side portion 9 may curve and/or taper at its front edge 11 and back edge 13 as seen on typical full size skateboards (not shown).

FIG. 1 also illustrates the rear portion 5 of the fingerboard skateboard 1. Moreover, as can be seen in the figure, the rear portion 5 is attached to the back edge 15 of the first side portion 7 and the second side portion 9. The rear portion 5 may be attached to the rear edge 15 by an attachment means 21. In an exemplary embodiment, the attachment means 21 may be a hinge 23. However, it has been contemplated that the attachment means 21 may be a flexible fiber, a spring or any other means that would allow for flexion of the rear portion 5 of the skateboard 1 relative to the front portion 3. With the use of the attachment means 21, the rear portion 5 is able to flex with the pressure that may be applied by a user to utilize the fingerboard skateboard to perform certain tricks with the skateboard 1 while in use. The attachment means 21 may allow for sufficient flexion of the rear portion 5 relative to the front portion 3 whereby the rear portion 5 may pivot vertically which may cause the front portion 3 of the fingerboard skateboard 1 to elevate off a flat surface corresponding to the pressure on the rear portion 5 of the board 1.

Figure 2:
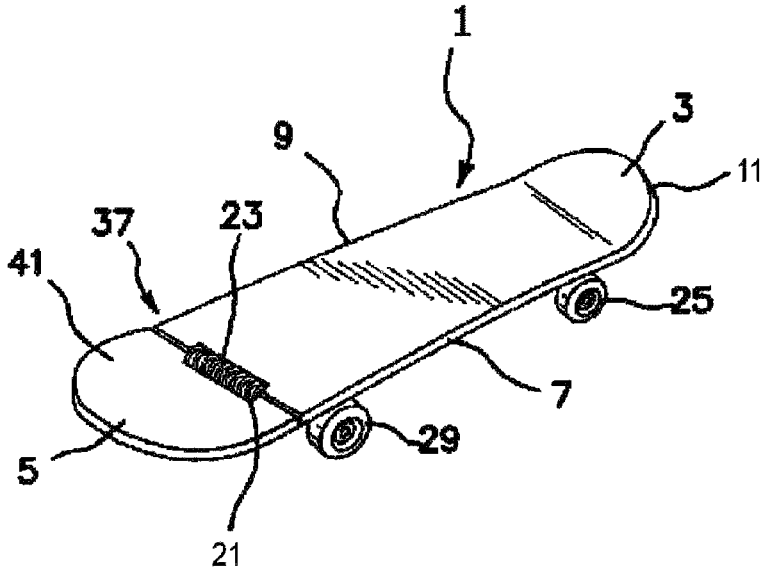
FIG. 2 is a second front perspective view of the device in an exemplary embodiment of the present invention.

FIG. 2 illustrates a perspective view of the fingerboard skateboard 1 that also illustrates the rear portion 5, the front portion 7 and the corresponding side portions 7, 9. Additionally, as shown in FIG. 2, the fingerboard skateboard 1 may have a plurality of wheels including a first wheel 25, a second wheel 27, a third wheel 29 and a fourth wheel 31. As further illustrated, the fingerboard skateboard 1 may have a first and second wheel 25, 27 which are coupled together on the bottom side 35 of the front portion 3 of the board 1. Moreover, the third and fourth wheel 29, 31 may be coupled together on the bottom side 35 of the rear edge 15 of the front portion 3 of the fingerboard skateboard 1. It is contemplated that the third and fourth wheels 29, 31 may be positioned on the bottom side 37 of the rear portion 5, however in the preferred embodiment, the wheels 29, 31 are located on the bottom side 35 of the front portion 3. The advantage of this placement may be that when sufficient pressure is put on the top side 41 of the rear portion 5 which is hingeably attached to the front portion 3, the flexion of the rear portion 5 may allow the third and fourth wheels 29, 31 (which may also be referred to as rear wheels) to stay in constant contact with a substantially flat surface 43, while the first and second wheels 25, 27 may be elevated away from the flat surface 43. Additionally, it is contemplated that either of the third and/or fourth wheels 29, 31 may be adaptable for movement independent of each other. For example, if a user (not shown) wishes to execute a skateboard 1 trick that requires the fingerboard skateboard 1 to flip, it may require the first and third wheels 25, 29 to elevate relative to the flat surface 43 while the second and fourth wheels 27, 31 are in communication with the flat surface until at least a portion of the flip exercise has begun, thereby causing the second and fourth wheels 27, 31 to move in conjunction with the first and third wheels 25, 29 whereby the entirety of the wheels are elevated and/or removed from contact with the flat surface while the trick is being performed.

Figure 3:
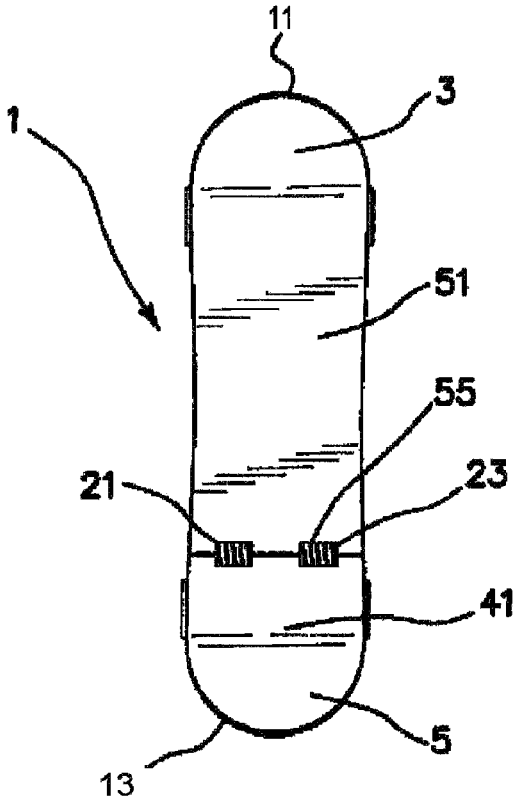
FIG. 3 is a top view of the device in an exemplary embodiment of the present invention.
Figure 4:
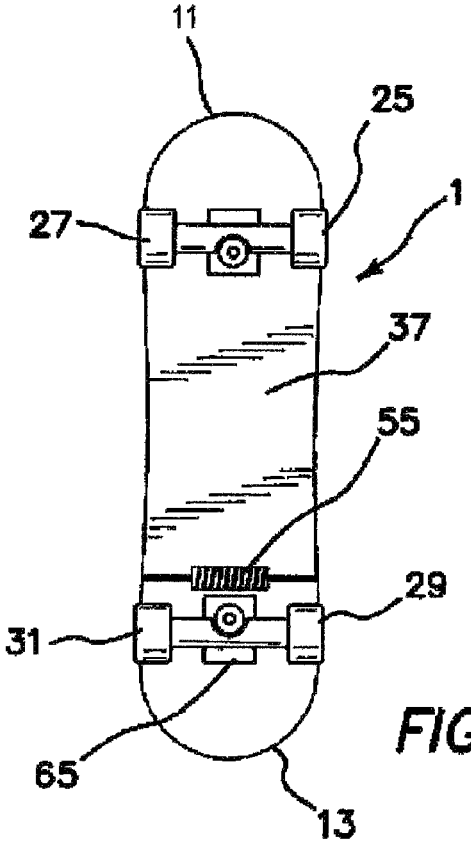
FIG. 4 is a bottom view of the device illustrating the spring mechanism in an embodiment of the present invention.

FIGS. 3 and 4 illustrate the top side 51 and the bottom side 37 of the skateboard 1. As illustrated in FIG. 3, the top side 51 of the skateboard may have a rear portion 5 that may be have a width wider than the width of the front portion 3. The advantage to having an increased width portion is such that a user may utilize the rear portion 5 more effectively with their finger when in use. Additionally, as illustrated in FIG. 3, an attachment means 21 may be provided whereby the attachment means may allow for hinged pivoting of the rear portion 5 about the front portion 3 of the fingerboard skateboard 1. In an exemplary embodiment, the attachment means 21 may be a spring mechanism 55. The spring mechanism 55 may attach the rear portion 5 of the skateboard 1 to the front portion 3 of the skateboard 1. The spring mechanism 55 may also allow for pivoting of the rear portion 5 in a vertical fashion extending both away from the flat surface directly after disengagement of the user's finger from the rear portion 5 and when engaged by the user's fingers, the pressure on the rear portion 5 may cause the spring to extend allowing flexion of the rear portion 5 towards the flat surface 43.

The spring mechanism 55 is further illustrated in FIG. 4 which shows the bottom side 37 of the fingerboard skateboard 1. Additionally, FIG. 4 illustrates the first and second wheels 25, 27 positioned in close proximity to the front edge 57 of the front portion 3 and the third and fourth wheels 29, 31 positioned in close proximity to the front edge 59 of the rear portion 5 of the fingerboard skateboard 1. However, it should be understood that the third and fourth wheels 29, 31, in an exemplary embodiment, may be located on the back edge 61 of the front portion 3. Additionally, as illustrated in FIG. 4, the wheels may contain an axle 65 whereby the axle may allow for independent movement of the wheels 29, 31 relative to each other. It is contemplated in an exemplary embodiment, that the axle 65 may allow for movement of the wheels 29, 31 in combination.

Figure 5:
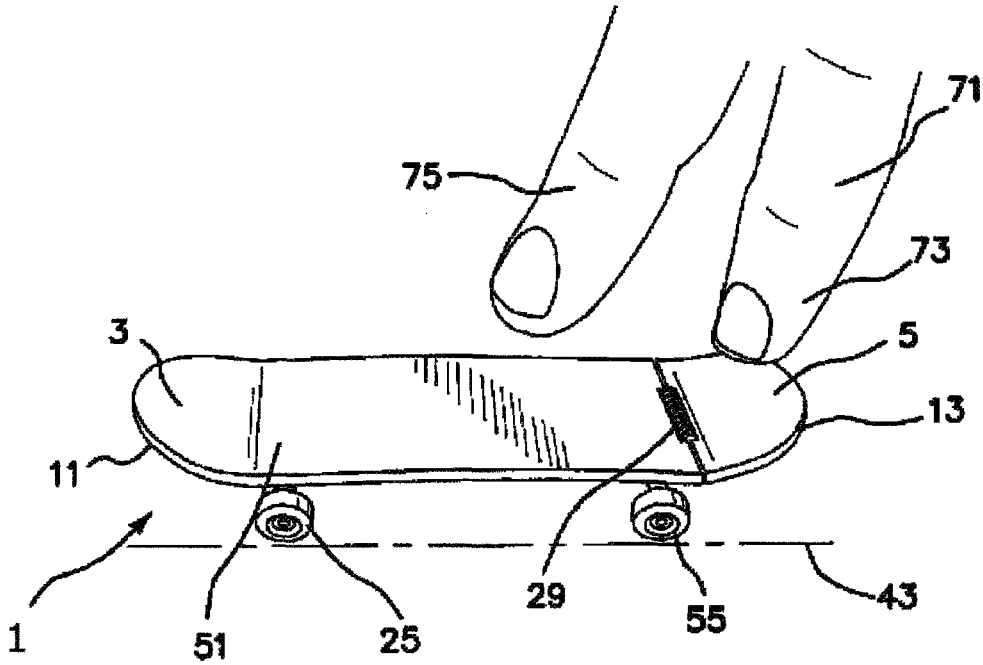
FIG. 5 is a perspective view of the device in use by an individual in an exemplary embodiment of the present invention.

FIG. 5 illustrates the fingerboard skateboard 1 in use. As illustrated in an exemplary embodiment, a user 71 may utilize at least a first finger 73 which may be the pointer finger, and a second finger 75 which may be the middle finger. However, it should be contemplated that any finger may be utilized in order to operate the fingerboard skateboard 1. In an exemplary embodiment, the user 71 may position the first finger 73 on a position at the front portion 3 of the skateboard 1 and the second finger 75 may be positioned on the rear portion 5 of the fingerboard skateboard 1. When the user 71 applies pressure to the rear portion 5 in a downward fashion, the rear portion 5 may flex about the spring mechanism 55 causing the rear portion 5 to more closely align with the flat surface 43 in which the skateboard 1 may be in contact with. The flexion of the rear portion 5 and the pressure thereon may cause the front portion 3 of the fingerboard skateboard 1 to elevate relative to the flat surface 43. The user 71 may utilize the first finger 73 to orientate and manipulate the front portion 5 of the fingerboard skateboard 1 in order to perform various stunts and tricks with the skateboard 1 as desired.

Thus, specific embodiments and applications of the release agent of the present invention have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A finger operated skateboard toy comprising:

a fingerboard skateboard including an elongated skateboard deck having a front nose portion, a rear tail kick portion, and an intermediate deck portion projecting between the front nose portion and the rear tail kick portion, each portion having an obstruction-free top surface and an opposing bottom surface, the surfaces cooperating to provide a finger engaging region providing multiple points of releasable engagement for a user's first and second fingers to move across, the finger engaging region being responsive to movement of the first and second fingers to maneuver and lift the skateboard deck to simulate one or more rider-bearing skateboard tricks normally conducted with a user's feet;

a first wheel truck coupled to the bottom surface of the skateboard deck within the front nose or intermediate deck portions and rotatably coupled to a first set of one or more wheels and;

a second wheel truck spaced apart from the first wheel truck and coupled to the bottom surface of the skateboard deck and rotatably coupled to a second set of one or more wheels with the wheels of the first and second trucks being operable to roll over an underlying support surface; and a flex element hingedly coupling the intermediate deck portion to the rear tail kick portion, the flex element being biased to maintain the rear tail kick portion in a normally upwardly bent position away from the underlying surface when both sets of wheels are placed on the underlying surface and no finger pressure is applied to the rear tail kick portion, the flex element further being operable to, with the user's first finger in contact with the top surface of the front nose or intermediate deck portions and the user's second finger in contact with the top surface of the rear tail kick portion of the skateboard deck and both sets of wheels on the underlying support surface, flex allowing depression of the rear tail kick portion by the user's second finger to rotate the rear tail kick portion about a transverse axis toward the underlying surface while increasing the normal force between the user's first finger and top surface of the skateboard deck to increase the frictional force therebetween, the flex element further being constructed to snap the rear tail kick portion in a depressed position back toward the normally upwardly bent position lifting the rear truck wheels off the underlying support surface when pressure exerted by the user's finger on the rear tail kick portion is removed.

2. The finger operated skateboard toy of claim 1 wherein: the flex element is a spring mechanism positioned between the front nose portion and the rear tail kick portion of the skateboard deck.

3. The finger operated skateboard toy of claim 1 wherein: the flex element is a hinge.

4. The finger operated skateboard toy of claim 1 wherein: the flex element is integrally attached to the intermediate deck portion of the skateboard deck.

5. The finger operated skateboard toy of claim 1 wherein: the flex element is integrally attached to the rear tail kick portion of the skateboard deck.

6. The finger operated skateboard toy of claim 1 wherein: the first wheel truck is positioned beneath the front nose portion of the skateboard deck and the second wheel truck is positioned beneath the rear tail kick portion of the skateboard deck.

7. The finger operated skateboard toy of claim 1 wherein: the first and second sets of wheels are constructed to rotate independently of one another.

8. The finger operated skateboard toy of claim 1 wherein: the sets of wheels of each truck are constructed to rotate dependently upon one another.

9. A finger operated skateboard toy comprising:

a miniature skateboard deck having an elongated, substantially planar, main section and a rear tail kick section, the sections cooperating to provide an unobstructed top surface constructed for tactile engagement with a pair of user's fingers, each section further having an underside defining a truck engagement surface, the top surface and underside of the skateboard deck each providing multiple points of engagement for the user's fingers to move across to maneuver and lift the skateboard deck to simulate rider-bearing skateboard tricks normally performed with a user's feet;

a front truck coupled to the truck engagement surface within the main section, the front truck including a set of wheels rotatably mounted to the front truck by a front axle;

a rear truck spaced apart from the front truck and coupled to the truck engagement surface, the rear truck including a set of wheels rotatably mounted to the rear truck by a rear axle with both sets of wheels constructed to roll over an underlying support surface; and a trick enhancing element hingedly coupling the main section to the rear tail kick section and further biasing the rear tail kick section into a bent configuration relative to the main section, the trick enhancing element being constructed to rotate the tail kick region out of the bent configuration toward the underlying support surface when both sets of wheels are on the underlying support surface and the top surface of the rear tail kick section is depressed by a user's finger, the trick enhancing element further being operable to snap the rear tail kick section back toward the bent configuration upon release of the user's finger on the rear tail kick section to launch the wheels of the rear truck off the underlying support surface.

10. The finger operated skateboard toy of claim 9 wherein: the rear tail kick section includes an enlarged tail flange wider than a width of the main section of the deck.

11. The finger operated skateboard toy of claim 9 wherein: the tail kick region projects upwardly from the main section.

12. The finger operated skateboard toy of claim 9 further including:

an upwardly projecting front nose region proximate an outer end of the main section.

13. The finger operated skateboard toy of claim 9 wherein: the miniature skateboard deck is equal to or less than 100 mm long.

14. The finger operated skateboard toy of claim 9 wherein: the trick enhancing element is biased to elevate the front truck wheels of the main section of the skateboard deck off an underlying surface when the rear tail kick section is depressed downwardly by a user's finger.

15. The finger operated skateboard toy of claim 9 wherein: the trick enhancing element is disposed in front of the rear truck along a length of the skateboard deck.

16. The finger operated skateboard toy of claim 9 wherein: the trick enhancing element is disposed behind the rear truck along a length of the skateboard deck.

17. The finger operated skateboard toy of claim 9 wherein: the trick enhancing element makes an audible clicking noise when the rear tail kick section is released after being depressed by the user.

* * * * *